US006087059A

United States Patent [19]

Duggan et al.

[11] Patent Number: 6,087,059

[45] Date of Patent: Jul. 11, 2000

[54] TONER AND DEVELOPER COMPOSITIONS

[75] Inventors: Michael J. Duggan, Webster; K. Derek Henderson; Amy L. Stamp, both of Rochester; Scott M. Silence, Fairport; William H. Hollenbaugh, Jr., Rochester; Edward J. Gutman, Webster, all of N.Y.; Bernard Grushkin, Bedford, Mass.; John G. Ruhland, Rochester, N.Y.

[73] Assignee: Xerox Corporation, Stamford, Conn.

[21] Appl. No.: 09/344,860

[22] Filed: Jun. 28, 1999

[51] Int. Cl.[7] ..... G03G 9/097

[52] U.S. Cl. ..... 430/111; 430/137

[58] Field of Search ..... 430/106, 109, 430/110, 111, 137

[56] References Cited

U.S. PATENT DOCUMENTS

| | | | |
|---|---|---|---|
| 2,986,521 | 5/1961 | Wielicki | 252/62.1 |
| 3,590,000 | 6/1971 | Palermitit et al. | 252/62.1 |
| 3,893,935 | 7/1975 | Jadwin et al. | 252/62.1 |
| 3,900,588 | 8/1975 | Fisher | 427/19 |
| 4,298,672 | 11/1981 | Lu | 430/108 |
| 4,338,390 | 7/1982 | Lu | 430/106 |
| 4,433,040 | 2/1984 | Niimura et al. | 430/109 |
| 4,560,635 | 12/1985 | Hoffend et al. | 430/106.6 |
| 4,640,882 | 2/1987 | Mitsuhashi et al. | 430/110 |
| 4,845,004 | 7/1989 | Kobayashi | 430/110 |
| 4,902,570 | 2/1990 | Heinemann et al. | 428/405 |
| 4,904,762 | 2/1990 | Chang et al. | 430/110 |
| 5,223,368 | 6/1993 | Ciccarelli et al. | 430/110 |
| 5,304,449 | 4/1994 | Hollenbaugh, Jr. | 430/110 |
| 5,352,556 | 10/1994 | Mahabadi et al. | 430/109 |
| 5,965,312 | 10/1999 | Nakazawa et al. | 430/111 |
| 5,981,132 | 11/1999 | Kurose et al. | 430/111 |

*Primary Examiner*—John Goodrow
*Attorney, Agent, or Firm*—E. O. Palazzo

[57] ABSTRACT

A toner comprised of resin, colorant and a surface additive mixture comprised of two coated silicas, and a coated metal oxide.

81 Claims, No Drawings

TONER AND DEVELOPER COMPOSITIONS

COPENDING APPLICATIONS AND PATENTS

Illustrated in copending applications and U.S. Pat. No. 6,004,714 the disclosure of which is totally incorporated herein by reference, is a toner comprised of resin, colorant and a coated silica, and a coating comprised of an alkylsilane; U.S. Ser. No. 132,185, the disclosure of which is totally incorporated herein by reference, is a toner with a coated silica with, for example, certain BET characteristics; and in U.S. Ser. No. 132,623, the disclosure of which is totally incorporated herein by reference, there is disclosed a toner comprised of resin, colorant and a coated silica, and wherein the silica has a primary particle size of about 25 nanometers to about 55 nanometers and an aggregate size of about 225 nanometers to about 400 nanometers, and wherein the coating is comprised of a mixture of an alkylsilane and an aminoalkylsilane generated, for example, from a mixture of about 10 weight percent to about 25 weight percent of an alkylalkoxysilane and about 0.10 weight percent to about 5.0 weight percent of an aminoalkylalkoxysilane. Also, disclosed in the aforementioned applications is a toner further containing surface additives of titania, metal salts of fatty acids, or mixtures thereof, and wherein the titania can be coated with a decylsilane. One advantage of the toners of the present invention compared to the toners of the above copending applications is the inclusion in the invention toners of a second coated silica additive which is preferably distinct, or dissimilar from the first coated silica additive in that the second silica possesses, for example, a primary particle size of about 5 nanometers to about 25 nanometers and an aggregate size of about 225 nanometers to about 400 nanometers, and the coating for the second silica is comprised of, for example, an organopolysiloxane. The admix characteristics of the toner of the present invention in embodiments can, for example, be controlled by the ratio of the amount of the metal oxide, like titania and the second silica additive, both preferably positively charging with respect to the toner. Further, the aforementioned ratio can be adjusted to compensate for other secondary factors which adversely affect the admix characteristics, such as the specific colorant used in the toner, the toner resin, carrier components, and the like. Specifically, especially for a cyan toner, the titania may be comprised of a SMT5103, which is believed to be comprised of a crystalline titanium dioxide core MT500B with a primary particle size of from about 25 to about 55 nanometers and a specific surface area of from about 30 to about 50 $m^2/g$, surface treated with decyl silane and wherein the SMT5103 can be obtained from Tayca Corporation, and the second silica may be comprised of H2050EP with a coating of polydimethyl siloxane units and with amino/ammonium functions chemically bonded onto the surface of highly hydrophobic fumed silica with a BET surface area of from about 110 ± to about 20 $m^2/g$, and wherein the H2050EP can be obtained from Wacker Chemie. When the sum of the concentrations of these two additives of the second coated silica and the coated titania or titanium dioxide is, for example, retained at about 2 percent by weight of the total toner composition, the admix characteristics of the toner can range from slow admix when the ratio of SMT5103 to H2050 is 0:100 to charge thru when the ratio is 100:0. At a ratio of 70:30, excellent admix characteristics are observed, with rapid admix and no charge thru of the added toner.

The appropriate components and processes of the copending applications, such as the alkylsilane coating, and the coated metal oxides, like titanium dioxide, may be selected for the present invention in embodiments thereof.

BACKGROUND OF THE INVENTION

The present invention is generally directed to toner and developer compositions, and more specifically, the present invention is directed to positively or negatively charged toner compositions, or toner particles containing a mixture of coated silica and coated metal oxides, such as titanium dioxide, surface additives, and yet more specifically, the present invention is directed to toners with surface additives comprised of two coated silicas, and a metal oxide, and wherein one of the silicas is usually a negatively charging silica, and the second silica is a positive charging silica (relative to the carrier), such as H2050EP. With the toners of the present invention, especially wherein the ratio amount of the coated silicas and the coated metal oxides, such as titanium dioxide, is preselected, there is enabled a number of advantages, such as the minimization or elimination of undesirable image background problems, avoiding slow admix charging, and toner charge thru problems; excellent stable triboelectric charging characteristics, reduced sensitivity to relative humidity, especially relative humidities of from about 20 to about 80 weight percent, superior toner flow acceptable triboelectric charging values, such as from about −15 to about −80 microcoulombs per gram as determined, for example, by the known Faraday Cage method, and wherein the toners enable the generation of developed images with superior resolution, and excellent color intensity. The aforementioned toner compositions can contain colorants, such as dyes or pigments comprised of, for example, carbon black, magnetites, or mixtures thereof, cyan, magenta, yellow, blue, green, red, orange, violet or brown components, or mixtures thereof, thereby providing for the development and generation of black and/or colored images, and in embodiments the toner can be selected for two component development and single component development wherein a carrier or carrier particles are avoided, and hybrid development systems which contain aspects of both two component and single component development.

Preferred as surface additives are an amino functionalized organopolysiloxane treated silicon dioxide, available as H2050EP from Wacker Chemie, and a decyl silane treated, or coated titanium dioxide available as SMT5103 from Tayca Corporation. More specifically, an example of the first silica is a relatively negative charging silica, NA50HS obtained from DeGussa/Nippon Aerosil Corporation, preferably approximately 30 nanometers of primary particle size and about 350 nanometers of aggregate size, or a fumed silica coated with a mixture of hexamethyldisilazane and aminopropyltriethoxysilane. Another example of the first silica is a relatively negative charging silica, DTMS obtained from Cabot Corporation, comprised of a fumed silica, for example silicon dioxide core L90 of approximately 30 nanometers of primary particle size and about 300 nanometers of aggregate size, and coated with decylsilane. An example of a metal oxide is SMT5103 crystalline titanium dioxide core MT500B, obtained from Tayca Corporation, with a primary particle size of from about 25 to about 55 nanometers and a specific surface of about 30 to about 50 $m^2/g$, surface treated or coated with decyl silane. As an example of the second silica, a relatively positive charging silica, H2050EP silica (nonparticulate) with polydimethylsiloxane units or segments, and amino/ammonium functions chemically bonded onto the surface of highly hydrophobic fumed silica, and which coated silica possesses a BET surface area of about 110 to about ±20 $m^2/g$ (obtained from Wacker Chemie). An example of a film-forming additive is a metal salt of a fatty acid, such as zinc stearate L obtained from Ferro Corporation.

The toner and developer compositions of the present invention can be selected for electrophotographic, especially xerographic, imaging and printing processes, including color, digital processes, and multisystems apparatus and machines.

PRIOR ART

Toner compositions with certain surface additives, including certain silicas, are known. Examples of these additives include colloidal silicas, such as certain AEROSILS like R972® available from Degussa, metal salts and metal salts of fatty acids inclusive of zinc stearate, aluminum oxides, cerium oxides, and mixtures thereof, which additives are each generally present in an amount of from about 1 weight percent by weight to about 5 weight percent by weight, and preferably in an amount of from about 1 weight percent by weight to about 3 weight percent by weight. Several of the aforementioned additives are illustrated in U.S. Pat. No. 3,590,000 and 3,900,588, the disclosures of which are totally incorporated herein by reference. Also known are toners containing a mixture of hexamethyldisilazane (HMDZ) and an aminopropyltriethoxysilane (APTES).

Further toner compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions. U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide, reference the Abstract of the Disclosure and column 3; and a similar teaching is presented in U.S. Pat. No. 4,312,933, which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. No. 3,944,493; 4,007,293; 4,079,014; 4,394,430 and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a toner which contains a metal complex represented by the formula in column 2, for example, and wherein ME can be chromium, cobalt or iron. Additionally, other patents disclosing various metal containing azo dyestuff structures wherein the metal is chromium or cobalt include 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives. These and other charge enhancing additives, such as these illustrated in U.S. Pat. Nos. 5,304,449, 4,904,762, and 5,223,368, the disclosures of which are totally incorporated herein by reference, may be selected for the present invention in embodiments thereof.

Other patents of interest are 4,902,570, 4,845,004, and 4,640,882.

SUMMARY OF THE INVENTION

Examples of features of the present invention in embodiments thereof include:

It is a feature of the present invention to provide toner and developer compositions with a mixture of certain surface additives, and wherein the toners possess a number of advantages.

In another feature of the present invention there are provided negatively charged toner compositions useful for the development of electrostatic latent images including color images.

In yet another feature of the present invention, there are provided negatively charged toner compositions useful for the development of electrostatic latent images including full process color images.

In another feature of the present invention there are provided toner surface additives that enable fast toner admix as measured by a charge spectrograph.

Also, in another feature of the present invention there are provided toners with a mixture, preferably of two coated silicas and coated metal oxide, such as titanium; surface additives that enable toner unimodal charge distribution as measured by a charge spectrograph.

Further, in another feature of the present invention there are provided certain surface additives that enable an unimodal charge distribution upon admix of fresh toner into aged toner as measured by a charge spectrograph.

Other features of the present invention include providing toner and developer compositions with a mixture of certain surface additives that enable acceptable high stable triboelectric charging characteristics from for example about −15 to about −80 microcoulombs per gram, and preferably from about −20 to about −70 microcoulombs per gram; toner and developer compositions with coated additives in certain ratios that enable reduced sensitivity to relative humidity, for example, about 20 to about 80 weight percent relative humidity at temperatures of from about 60 to about 80° F. as determined in a relative humidity testing chamber; toner and developer compositions with a mixture of certain surface additives that enable negatively charged toner compositions with desirable admix properties of 1 second to about 60 seconds as determined by the charge spectrograph, and more preferably less than about 30 seconds; toner compositions with a mixture of certain surface additives that enable, for example, low temperature fusing resulting in high quality black and/or color images; and the formation of toners with a mixture of certain surface additives which will enable the development of images in electrophotographic imaging apparatuses, which images have substantially no background deposits thereon, are substantially smudge proof or smudge resistant, and therefore are of excellent resolution, and further, such toner compositions can be selected for example, for high speed electrophotographic apparatuses, that is those exceeding about 60 copies per minute or prints per minute, and more specifically, from about 60 to about 240 or greater copies per minute or prints per minute.

In another feature of the present invention there are provided positively charged toner compositions useful for the development of electrostatic latent images including color images.

In yet a further feature of the present invention there are provided reduced sensitivity to relative humidity, from about, for example, 20 to about 80 weight percent relative humidity at temperatures of from about 60 to about 80° F. as determined in a relative humidity testing chamber positively charged toner compositions with desirable admix properties of about 5 seconds to about 60 seconds as determined by the charge spectrograph, and preferably less than about 15 seconds, for example, and more preferably from about 1 to about 14 seconds, and acceptable high stable triboelectric charging characteristics of from about −20 to about −70 microcoulombs per gram.

Another feature of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies or xerographic prints per minute.

Aspects of the present invention are directed to a toner comprised of resin, colorant and a mixture of surface additives of a coated metal oxide and at least two coated silicas, and wherein the first silica possesses, for example, a primary particle size of about 25 nanometers to about 55 nanometers, about 5 to about 60, preferably about 25 nanometers, and an aggregate size of about 225 nanometers to about 400 nanometers, and the second silica possesses, for example, a primary particle size of from about 5 to about 60, preferably to about 25, and from about 5 nanometers to about 25 nanometers and an aggregate size of about 225 nanometers to about 400 nanometers, and wherein the ratio of coated metal oxide to the second coated silica is from about 20:80 to about 98:2, from about 65:35 to about 95:5, about 98:2 to 40:60, 98:2 to 60:40, 95.5 to 70:3, and most preferably about 95:5 to 85:15; a toner wherein as an example the first silica coating is generated from a mixture of about 10 weight percent to about 25 weight percent of an alkylalkoxysilane and about 1.10 weight percent to about 5.0 weight percent of an aminoalkylalkoxysilane; a toner wherein the second silica coating is generated from an organopolysiloxane; a toner which further contains surface additives of metal oxides, metal salts, metal salts of fatty acids, or mixtures thereof; a toner wherein the resin is polyester; a toner wherein the resin is a polyester formed by condensation of propoxylated bisphenol A and a dicarboxylic acid; a toner wherein the resin is comprised of a mixture of a polyester formed by condensation of propoxylated bisphenol A and fumaric acid, and a gelled polyester formed by condensation of propoxylated bisphenol A and fumaric acid; a toner wherein the colorant is carbon black, magnetites, or mixtures thereof, cyan, magenta, yellow, blue, green, red, orange, violet or brown, or mixtures thereof; a toner wherein the first silica is coated with decylsilane, or with a mixture of an alkylsilane and an aminoalkylsilane; a toner wherein alkyl contains from about 1 to about 25 carbon atoms; a toner wherein alkyl is butyl, hexyl, octyl, decyl, dodecyl, or stearyl; a toner wherein the silica is coated with a polymer mixture of (1) an alkylsilane, and (2) an aminoalkylsilane; a toner wherein the titania or titanium dioxide is coated with an alkylsilane; a toner wherein the titania is coated with decylsilane; a toner wherein the first silica is coated with an input feed mixture of about 5 weight percent to about 25 weight percent alkyltrialkoxysilane and about 0.05 weight percent to about 5.0 weight percent aminoalkyltrialkoxysilane; a toner wherein alkyl contains from 1 to about 25 carbon atoms; a toner wherein the silica is coated with an input feed mixture of about 5 to about 25 weight percent decyltrialkoxysilane and optionally about 0.15 weight percent to about 0.50 weight percent aminoalkyltrialkoxysilane; a toner wherein the first silica has a primary particle size of about 25 nanometers to about 55 nanometers, and the coating thereof is present on a core of silicon dioxide; a toner wherein the second silica has a primary particle size of about 5 nanometers to about 25 nanometers, and the coating thereof is present on a core of silicon dioxide; a toner wherein the colorant is a pigment, or a dye; a toner wherein the first silica has a primary particle size of about 25 nanometers to about 55 nanometers and the second silica has a primary particle size of about 5 nanometers to about 25 nanometers; a toner wherein the first silica has an aggregate size of about 225 nanometers to about 400 nanometers; or has an aggregate size of about 300 nanometers to about 375 nanometers, and the second silica has an aggregate size of about 225 nanometers to about 400 nanometers; or has an aggregate size of about 300 nanometers to about 375 nanometers; a toner wherein the first coated silica is present in an amount of from about 1 weight percent to about 10 weight percent; a toner wherein the first coated silica is present in an amount of from about 3 weight percent to about 8 weight percent; a toner wherein the second coated silica is present in an amount of from about 0.1 weight percent to about 3 weight percent; a toner wherein the second coated silica is present in an amount of from about 0.1 weight percent to about 1.0 weight percent; a toner wherein the titania is present in an amount from about 1 weight percent to about 5 weight percent, or wherein the titania is present in an amount from about 1.0 weight percent to about 4.0 weight percent; a toner wherein the metal salt of a fatty acid is zinc stearate and is present in an amount from about 0.10 weight percent to about 0.80 weight percent; a toner with a triboelectric charge of from about −15 to about −80, or with a triboelectric charge of from about −20 to about −70; a toner wherein the resin is present in an amount of from about 80 weight percent to about 98 weight percent and the colorant is present in an amount from about 20 weight percent to about 2 weight percent; a developer comprised of toner and carrier; a developer with a unimodal charge distribution as measured by a charge spectrograph; a toner further optionally containing a charge additive, a wax, or mixtures thereof; a process for the preparation of a toner comprising admixing resin, colorant, and optional toner additives, such as a wax, and subsequently blending with coated silicas and a coated metal oxide and metal salts, metal salts of fatty acids, or mixtures thereof; toners comprised of a binder, such as resin particles, colorant, and surface additives comprised of a mixture of certain silicas, metal oxides, such as titanias, especially titanium dioxides (titania, $TiO_2$, titanium dioxide), and certain conductivity aides such as metal salts of fatty acids, such as zinc stearate; and toner compositions comprised of binder, colorant, optional additives such as charge additives, surface additives such as certain titanias and conductivity aides such as zinc stearate, and surface additives comprised of a mixture of certain silicas in which one silica is coated with an alkylsilane, such as decylsilane; a toner comprised of binder, colorant and a surface additive mixture comprised of a first coated silica, a second coated silica, and a coated metal oxide; a toner wherein the metal oxide is titanium dioxide; a toner further containing metal salts of fatty acids; an imaging method comprising developing an image with the toner illustrated herein; an imaging apparatus containing the toner and developer illustrated herein; a toner comprised of resin, colorant and a surface additive mixture comprised of at least two, and preferably two coated silicas, a coated metal oxide, and metal salts, metal salts of fatty acids or mixtures thereof; a toner wherein two coated silicas are selected and which silicas are comprised of a first silica and a second positively charging silica, and wherein the ratio amount of the coated metal oxide to the positively charging second coated silica ranges from about 98:2 to about 20:80; a toner wherein two coated silicas are selected and which silicas are comprised of a first silica and a second positively charging silica, and wherein the ratio amount of the coated metal oxide to the positively charging second coated silica ranges from about 55:45 to about 40:60; a toner wherein the metal oxide is titanium dioxide; a toner wherein the metal oxide is titanium dioxide; a toner wherein the two coated silicas are comprised of a first silica and a second silica, and wherein the second silica is coated with an organopolysiloxane and wherein the metal oxide is titanium dioxide; a toner comprised of resin, colorant and a surface additive mixture comprised of two coated silicas, a coated metal oxide, and metal salts, metal salts of fatty acids or mixtures thereof, and wherein the ratio amount of the coated metal oxide to the second coated silica ranges from about 98:2 to about 20:80; a toner wherein the two coated silicas are comprised of a first silica and a second silica, and wherein the first silica possesses a primary particle size of about 25 nanometers to about 55 nanometers; a toner wherein the second silica or a silica other than the first coated silica is a relatively positively charging silica, that is for example positively charging relative to the toner surface measured by determining the toner triboelectric charge with and without the coated silica; and a toner wherein the two coated silicas are comprised of a first silica and a second silica, and wherein the first, second, or both silicas possess a primary particle size of about 5 nanometers to about 25 nanometers.

Preferred examples of the coated silicas and the coated titanium dioxides selected for the toners of the present invention are a negative charging silica NA50HS, relative to the carrier obtained from DeGussa/Nippon Aerosil Corporation a negative charging silica, relative to the carrier of DTMS obtained from Cabot Corporation, a fumed silica core L90 of approximately 30 nanometers of primary particle size and about 300 nanometers of aggregate size, and coated with decylsilane; a treated titania, SMT5103 crystalline titanium dioxide core MT500B with a primary particle size of about 25 to about 55 nanometers and a specific surface area of about 30 to about 50 $m^2/g$, surface treated with decyl silane and (obtained from Tayca Corporation); a positive charging silica, relative to the carrier coating, H2050EP silica with polydimethylsiloxane units or segment together with amino/ammonium functions both chemically bonded onto the surface of a highly hydrophobic fumed silica with a BET surface area of 110±20 $m^2/g$ (obtained from Wacker Chemie). Other examples of metal oxides in addition to titanium dioxide are aluminum oxide, cerium oxide, zinc oxide, iron oxide and other suitable known oxides. A metal salt of a fatty acid, such as zinc stearate obtained from Ferro Corporation can be present as a toner surface additive.

The toner compositions of the present invention can be prepared by mixing, preferably melt mixing, and heating resin particles such as styrene polymers, polyesters, and similar thermoplastic resins, colorant, wax, especially low molecular weight waxes, and charge enhancing additives, or mixtures of charge additives in a toner extrusion device, such as the ZSK40 and ZSK53 available from Werner Pfleiderer, and removing the formed toner composition from the device. Subsequent to cooling, the toner composition is subjected to grinding utilizing, for example, a Sturtevant micronizer, reference U.S. Pat. No. 5,716,751, the disclosure of which is totally incorporated herein by reference, for the purpose of achieving toner particles with a volume median diameter of less than about 25 microns, and preferably of from about 4 to about 12 microns, which diameters are determined by a Coulter Counter. Subsequently, the toner compositions can be classified utilizing, for example, a Donaldson Model B classifier for the purpose of removing fines, that is toner particles less than about 5 microns by population. Thereafter, the surface additive mixture and other additives are added by the blending thereof with the toner obtained.

Illustrative examples of suitable toner binders, include toner resins, especially polyesters, thermoplastic resins, polyolefins, styrene acrylates, such as PSB-2700 obtained from Hercules-Sanyo Inc., styrene methacrylate, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene, reference the U.S. patents mentioned herein, the disclosures of which have been totally incorporated herein by reference. In addition, crosslinked resins, including polymers, copolymers, homopolymers of the aforementioned styrene polymers, may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; Pliolites; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, reactive extruded resin, especially reactive extruded polyesters with crosslinking as illustrated in U.S. Pat. No. 5,352,556, the disclosure of which is totally incorporated herein by reference, styrene acrylates, and mixtures thereof. Also, optional waxes with a molecular weight $M_w$ weight average molecular weight of for example from about 1,000 to about 20,000, such as polyethylene, polypropylene, and paraffin waxes, can be included in or on the toner compositions as fuser roll release agents. The resin is present in a sufficient, but effective amount, for example from about 50 to about 98 weight percent.

Colorant includes pigment, dyes, mixtures thereof, mixtures of dyes, mixtures of pigments and the like present in suitable amounts such as from about 1 to about 20 and preferably from about 2 to about 10 weight percent. Colorant examples are carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Other colorants are magenta colorants of (Pigment Red)PR81:3, Cl 45160:3. Illustrative examples of cyans that may be selected include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL, PY17, Cl 21105, and known suitable dyes, such as red, blue, green, Pigment Blue 15:3 C.I. 74160, Pigment Red 81:3 C.I. 45160:3, and Pigment Yellow 17 C.I. 21105, and the like, reference for example U.S. Pat. No. 5,556,727, the disclosure of which is totally incorporated herein by reference.

Magnetites include a mixture of iron oxides ($FeO \cdot Fe_2O_3$), including those commercially available as MAPICO BLACK™, and are present in the toner composition in various effective amounts, such as an amount of from about 10 weight percent by weight to about 75 weight percent by weight, and preferably in an amount of from about 30 weight percent by weight to about 55 weight percent by weight.

There can be included in the toner compositions of the present invention charge additives as indicated herein in various effective amounts, such as from about 1 to about 19, and preferably from about 1 to about 3 weight percent, and waxes, such as polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K. K., and the like. The commercially available polyethylenes selected have a molecular weight of from about 1,000 to about 1,500, while the commercially available polypropylenes utilized are believed to have a molecular weight of from about 4,000 to about 7,000. Many of the polyethylene and polypropylene compositions useful in the present invention are illustrated in British Patent No. 1,442,835, the disclosure of which is totally incorporated herein by reference. The wax may be present in the toner composition of the present invention in various amounts, however, generally these waxes are present in the toner composition in an amount of from about 1 weight percent by weight to about 15 weight percent by weight, and preferably in an amount of from about 2 weight percent by weight to about 10 weight percent by weight. The toners of the present invention may also in embodiments thereof contain polymeric alcohols, such as UNILINS, reference U.S. Pat. No. 4,883,736, the disclosure of which is totally incorporated herein by reference, and which UNILINS® are available from Petrolite Corporation.

Developers include the toners illustrated containing as additives a mixture of silicas, titania and metal salts of fatty acids like zinc stearate on the surface and carrier particles. Developer compositions can be prepared by mixing the toners with known carrier particles, including coated carriers, such as steel, ferrites, and the like, reference U.S. Pat. Nos. 4,937,166 and 4,935,326, the disclosures of which are totally incorporated herein by reference, for example from about 2 weight percent toner concentration to about 8 weight percent toner concentration. The carriers can include coatings thereon, such as those illustrated in the 4,937,166 and 4,935,326 patents, and other known coatings. There can be selected a single coating polymer, or a mixture of polymers. Additionally, the polymer coating, or coatings may contain conductive components therein, such as carbon black in an amount, for example, of from about 10 to about 70 weight percent, and preferably from about 20 to about 50 weight percent. Specific examples of coatings are fluorocarbon polymers, acrylate polymers, methacrylate polymers, silicone polymers, polyurethanes, and the like.

Imaging methods are also envisioned with the toners of the present invention, reference for example a number of the patents mentioned herein, and U.S. Pat. Nos. 4,868,600, 4,585,884; 4,584,253; 4,563,408 and 4,265,990, the disclosures of which are totally incorporated herein by reference.

The following Examples are being submitted to further define various pieces of the present invention. These Examples are intended to be illustrative only and are not intended to limit the scope of the present invention. Comparative Examples and data are also submitted.

EXAMPLE I

A toner, a toner resin was prepared by a polycondensation reaction of propoxylated bisphenol A and fumaric acid to form a linear polyester referred to as Resapol HT. A second polyester was prepared by selecting Resapol HT and adding to it in an extruder a sufficient amount of benzoyl peroxide to form a crosslinked polyester with a high gel concentration of about 30 weight percent gel, reference U.S. Pat. Nos. 5,376,494; 5,395,723; 5,401,602; 5,352,556, and 5,227,460, and more specifically, the polyester of the '494 patent, the disclosures of each of these patents being totally incorporated herein by reference.

In the second step, 75 Parts by weight of the resin Resapol HT from above, 14 parts by weight of the 30 weight percent gel polyester from above, and 11 parts by weight of Sun Blue Flush, which is a mixture of 30 weight percent P.B.15:3 copper phthalocyanine (C.I. 74160) and 70 weight percent Resapol HT prepared at Sun Chemical by flushing to obtain a high quality pigment dispersion were blended together and extruded in a ZSK-40 extruder. The extruded blend was then jetted and classified to form a cyan toner (with 96.7 weight percent of resin and 3.3 weight percent of P.B. 15:3) with a toner particle size of about 7.3 microns as measured by a Layson Cell. The final cyan toner had a gel concentration of about 5 weight percent.

In the third step, a toner blend was prepared by mixing the cyan toner above with 3.5 weight percent of NA50HS silica obtained from DeGussa/Nippon Aerosil Corporation, 1.4 weight percent of SMT5103 comprised of a crystalline titanium dioxide core MT500B with a primary particle size of about 25 to about 55, and more specifically 40 throughout the Examples, nanometers and a specific surface area of about 30 to about 50 $m^2/g$, and more specifically 40 throughout the Examples, surface treated with decyl silane (obtained from Tayca Corporation); 0.6 weight percent of H2050EP silica ($S_1O_2$) with polydimethylsiloxane units together with amino/ammonium functions chemically bonded onto the surface of the hydrophobic fumed silica, and which coated silica possesses a BET surface area of 110±20 $m^2/g$, and more specifically 110 throughout the Examples, (obtained from Wacker Chemie), and 0.3 weight percent of zinc stearate L obtained from Ferro Corporation. The resulting toner was coated onto the surface 3.5 percent of the negatively charging surface additive NA50HS and 2.0 percent of the positively charging external additives, SMT5103 and H2050EP, where the ratio of the two additives SMT5103/H2050EP is 70/30. The mixing was accomplished using a 10 Liter Henschel vertical blender at 2,360 rpm for a blend time of 4 minutes.

A developer was prepared by mixing 4 parts of the above prepared blended toner with 100 parts of a carrier composed of a 77 micron volume median diameter atomized steel core (obtained from Hoeganaes) which is coated with 1.0 percent of coating weight polymer composite of 15.0 weight percent of poly(DIAEMA-co-MMA) (92 percent/8 percent monomer ratio), 72.25 weight percent of crosslinked polyester/polyurethane polymer (Envirocron PCU10101, obtained from PPG Industries), and 12.75 weight percent of conductive carbon black (Conductex SC Ultra, obtained from Columbian Chemical), reference U.S. Ser. Nos. 140,437, 140,524, 140,594, 140,439 and 140,998, the disclosures of each of these patents being totally incorporated herein by reference.

The admix properties of this developer were characterized by the following procedure. The developer was aggressively mixed in a paint shaker (Red Devil 5400, modified to run between 600 and 650 RPM) for a period of 90 minutes. It is believed that this process simulates a mechanical energy input to a toner particle equivalent to that applied in a xerographic housing environment in a low toner throughout mode. After 90 minutes, the tribo was −28.0 microcoulombs per gram. At the end of the 90 minutes of aging, 2 percent fresh toner was added to the developer, bringing the total toner concentration in the developer to 6 percent. The developer was then further mixed on the paint shaker for time periods of 15 seconds, 30 seconds, 60 seconds, 120 seconds, and 300 seconds (cumulative mixing times). At the end of each of these mixing times, a spectrum of the charge distribution was obtained of the developer with using the charge spectrograph, reference U.S. Pat. No. 4,375,673, the disclosure of which is totally incorporated herein by reference. The charge spectra for these developers, when expressed as particle number (y-axis) plotted against toner charge divided by the toner diameter (x-axis), consisted of one or more peaks, and the toner charge divided by diameter (referred to as toner Q/d) value (values) at the particle number maximum (maxima) served to characterize the developers. Frequently, the charge spectra consisted of two distinct peaks, one for the toner which has been aged aggressively for 90 minutes in the developer (referred to as the incumbent toner) and the other for the toner which was added to the developer prior to the gentle mixing (referred to as the fresh toner). In this case, a measure of the quality of the admix was the peak separation (incumbent peak—fresh peak, referred to as delta Q/d), averaged over the paint shake mixing times (15 seconds to 300 seconds). A positive average delta Q/d indicated that the fresh toner had a higher Q/d value than the incumbent toner, a phenomena referred to as charge thru, whereas a negative delta Q/d indicated that the incumbent toner had a higher Q/d value than the fresh toner, a phenomena referred to as slow admix. The optimum condition was zero delta Q/d, where there was no separation between the incumbent and fresh toner peaks (unimodal distribution) for all mixing times from 15 to 300 seconds. This developer in this Example gave an average delta Q/d value of 0.1 femtocoulomb per micron, indicating a very low level of toner charge-thru.

The admix properties of this developer were characterized in a xerographic developer housing. The test fixture was based on a 4890 printer modified from tri-level Xerography to run in Discharged Area Development only and using a Hybrid Scavengeless Development subsystem, reference U.S. Pat. No. 4,868,600 (and possibly 4,459,009; 4,618,241; 4,505,573; 4,764,841; 5,031,570). The stress condition for the appearance of toner admix problems, either charge-thru or slow admix, occured after the developer had been run for 7,500 copies at the minimal print area coverage of 2 percent of the page and minimal addition of toner to the developer, a condition equivalent to the aggressive mixing carried out above in the paint shaker, at which a transition to a high print area coverage of 50 percent of the page occurs along with a sudden high influx of toner to the developer. At the end of 2 percent area coverage, the tribo was −20.3 microcoulombs per gram. The average delta Q/d was zero during and shortly after (100 to 500 prints) this transition; that is, all charge spectra were unimodal. More importantly, there was no increase in background on the prints that were made during the period, a consequence of toner with low (or negative) Q/d values associated with poor admix characteristics, either slow admix or charge-thru.

COMPARATIVE EXAMPLE 1

Toner Exhibiting Charge-thru:

A toner was prepared in the same manner as that of Example I, except that in the third step of the process, a toner blend was prepared by mixing the cyan toner above with 2.5 weight percent of NA50HS silica obtained from DeGussa/

Nippon Aerosil Corporation, 2.0 weight percent of SMT5103 crystalline titanium dioxide core MT500B with a primary particle size of about 25 to about 55 nanometers and a specific surface area of about 30 to about 50 $m^2/g$, surface treated with decyl silane (obtained from Tayca Corporation), 0.0 weight percent of H2050EP silica with polydimethylsiloxane units together with amino/ammonium functions chemically bonded onto the surface of highly hydrophobic fumed silica with a BET surface area of 110±20 $m^2/g$ obtained from Wacker Chemie, and 0.3 weight percent of zinc stearate L from Ferro Corporation. Therefore, overall this toner had coated onto the surface 2.5 percent of the negatively charging surface additive NA50HS and 2.0 percent of the positively charging external additives, SMT5103 and H2050EP, where the ratio of the two additives SMT5103/H2050EP ratio is 100/0. The mixing was accomplished using the same condition as that of Example I.

A developer was prepared by mixing 4 parts of the blended toner with 100 parts of a carrier composed of a 77 micron volume median diameter atomized steel core (obtained from Hoeganaes) which was coated with 1.0 percent coating weight polymer composite which consisted of 25.0 weight percent of poly(DIAEMA-co-MMA) (84 percent/16 percent monomer ratio), 60.0 weight percent of crosslinked polyester/polyurethane polymer (Envirocron PCU10101, obtained from PPG Industries), and 15.0 weight percent of conductive carbon black (Conductex SC Ultra, obtained from Columbian Chemical), reference U.S. Ser. Nos. 140,437, 140,524, 140,594, 140,439 and 140,998, the disclosures of each of these applications being totally incorporated herein by reference.

The admix properties of this developer were characterized by the procedure described in Example I. After 90 minutes of paint shaking, the tribo was −40.0 microcoulombs per gram. This developer in this Comparative Example provided an average delta Q/d value of 1.6 femtocoulombs per micron, indicating a very high level of toner charge-thru. The freshly added toner had a very negative charge of (−1.5) femtocoulombs per micron, while the incumbent toner had positive charge of (+0.1) femtocoulombs per micron. These bimodal charge distributions resulted in extremely high corrected wrong sign toner (the percentage of the toner between 3 and 15 microns in size a positive, or wrong sign, polarity) and corrected low charge toner (the percentage of the toner between about 3 and about 15 microns in size that had charge greater than (−0.1) femtocoulombs per micron). In this Example corrected wrong sign had reached 46 percent, and corrected low charge reached 59 percent of the toner population sampled. In the xerographic developer housing described herein, evaluations of developers that display similar levels of charge-thru exhibited severe machine dirt and background on the prints following the transition from 2 percent area coverage to 50 percent area coverage.

COMPARATIVE EXAMPLE 2

Toner Exhibiting Slow Admix:

A toner was prepared in the same manner as that of Example I, except that in the third step of the process, a toner blend was prepared by mixing the cyan toner above with 4.5 weight percent of a fumed silica core L90 of approximately 30 nanometers of primary particle size and about 300 nanometers of aggregate size, and coated with decylsilane (obtained from Cabot Corporation), 0.0 weight percent of SMT5103 crystalline titanium dioxide core MT500B with a primary particle size of about 25 to about 55 nanometers and a specific surface area of about 30 to about 50 $m^2/g$, surface treated with decyl silane (obtained from Tayca Corporation), 2.0 weight percent of H2050EP silica with polydimethylsiloxane units together with amino/ammonium functions chemically bonded onto the surface of highly hydrophobic fumed silica with a BET surface area of 110±20 $m^2/g$ (obtained from Wacker Chemie), and 0.3 weight percent of zinc stearate L obtained from Ferro Corporation. This toner thus had coated onto the surface 4.5 percent of the negatively charging surface additive DTMS and 2.0 percent of the positively charging external additives, SMT5103 and H2050EP, where the ratio of the two additives SMT5103/H2050EP was 0/100. The mixing was accomplished using the same condition as that of Example I.

A developer was prepared by mixing 4 parts of the blended toner with 100 parts of a carrier composed of a 77 micron volume median diameter atomized steel core (obtained from Hoeganaes) which was coated with 1.0 percent coating weight of a crosslinked polyester/polyurethane polymer (Envirocron PCU10101, obtained from PPG Industries), reference U.S. Ser. Nos. 140,437, 140,524, 140,594, 140,439 and 140,998, the disclosures of each of these applications being totally incorporated herein by reference.

The admix properties of this developer were characterized by the procedure described in Example I. After 90 minutes of paint shaking, the tribo was −11.2 microcoulombs per gram. This developer in this Comparative Example gave an average delta Q/d value of −0.75 femtocoulombs per micron, indicating a very high level of toner slow admix. The fresh toner had a positive charge (wrong sign) of (+0.34) femtocoulombs per micron upon addition to the developer that had been mixed for 90 minutes (polarity opposite to the incumbent toner). The fresh toner took in excess of 5 minutes of paint shaking to charge to the same polarity as the incumbent toner, which had an average negative charge of (−0.41) femtocoulombs per micron. Such bimodal charge distributions resulted in high corrected wrong sign and corrected low charge (as high as 40 percent and 46 percent, respectively, in this Example). In the xerographic developer housing described in Example I, evaluations of developers that displayed similar levels of slow admix exhibited severe machine dirt and background at 50 percent area coverage.

EXAMPLE II

A toner was prepared in the same manner as that of Example I, except that in the second step of the process to produce toner 55.34 parts by weight of the resin Resapol HT from above, 17.99 parts by weight of the 30 weight percent gel polyester from above, and 26.67 parts by weight of Sun Resin Bond Flush Yellow, which is a mixture of 30 weight percent of P.Y.17 (C.I. 21105) and 70 weight percent of Resapol HT prepared at Sun Chemical by flushing to obtain a high quality pigment dispersion, were blended together and extruded in a ZSK-40 extruder. The extruded blend was then jetted and classified to form a yellow toner (with 92 weight percent of resin and 8 weight percent of P.Y. 17) with a toner particle size of about 7.3 microns as measured by a Layson Cell. The final yellow toner had a gel concentration of about 5 weight percent.

In the third step of the process to produce a toner, a toner blend was prepared by mixing the yellow toner above with 3.5 weight percent of NA50HS silica obtained from DeGussa/Nippon Aerosil Corporation, 1.4 weight percent of SMT5103 crystalline titanium dioxide core MT500B with a primary particle size of about 25 to about 55 nanometers and a specific surface area of about 30 to about 50 $m^2/g$, surface treated with decyl silane (obtained from Tayca Corporation), 0.6 weight percent of H2050EP silica with polydimethylsiloxane units together with amino/ammonium functions chemically bonded onto the surface of highly hydrophobic fumed silica with a BET surface area of 110±20 $m^2/g$ (obtained from Wacker Chemie), and 0.3 weight percent of zinc stearate L from Ferro Corporation. Therefore, overall this toner contained coated onto the surface 3.5 percent of the negatively charging surface additive NA50HS and 2.0 percent of the positively charging external additives, SMT5103 and H2050EP, where the ratio of the two additives SMT5103/H2050EP was 70/30. The mixing was accomplished using the same condition as that of Example I.

A developer was prepared by mixing 4 parts of the blended toner with 100 parts of a carrier identical to that of Example I. The admix properties of this developer were characterized by the procedure described in Example I. After 90 minutes of paint shaking, the tribo was −36.2 microcoulombs per gram. This developer provided an average delta Q/d value of zero femtocoulombs per micron, indicating an excellent admix performance. The freshly added toner and the incumbent toner charged to the same value of Q/d, and had a unimodal charge distribution at all times examined (15 seconds to 5 minutes paint shaker). The admix properties of this developer were characterized in a xerographic developer housing as in Example I. On termination of 2 percent area coverage, the toner tribo was −30.7 microcoulombs per gram. The average delta Q/d was zero (unimodal distribution) during and shortly after (100 to 500 prints) the transition to a high print area coverage of 50 percent of the page. More importantly, there was no increase in background on the prints that were generated during the period, a consequence of toner with low (or negative) Q/d values associated with poor admix.

EXAMPLE III

A toner was prepared in the same manner as that of Example I, except that in the third step of the process to produce toner, a toner blend was prepared by mixing the cyan toner from Example I with 4.0 weight percent of a fumed silica core L90 of approximately 30 nanometers of primary particle size and about 300 nanometers of aggregate size, and coated with decylsilane, (obtained from Cabot Corporation), 1.88 weight percent of SMT5103 crystalline titanium dioxide core MT500B with a primary particle size of about 25 to about 55 nanometers and a specific surface area of about 30 to about 50 $m^2/g$, surface treated with decyl silane (obtained from Tayca Corporation), 0.63 weight percent of H2050EP silica with polydimethylsiloxane units together with amino/ammonium functions chemically bonded (chemically) onto the surface of highly hydrophobic fumed silica and with a BET surface area of 110±20 $m^2/g$ (obtained from Wacker Chemie), and 0.3 weight percent of zinc stearate L from Ferro Corporation. Therefore, overall this toner has coated onto the surface 4.0 percent of the negatively charging surface additive DTMS and 2.5 percent of the positively charging external additives, SMT5103 and H2050EP, where the ratio of the two additives SMT5103/H2050EP ratio was 75/25. The mixing was accomplished using the same condition as that of Example I.

A developer was prepared by mixing 4 parts of the blended toner with 100 parts of a carrier composed of a 77 micron volume median diameter atomized steel core (obtained from Hoeganaes) which is coated with 1.0 percent coating weight polymer composite which consists of 20.0 weight percent poly(DIAEMA-co-MMA) (92 percent/8 percent monomer ratio), 68.0 weight percent crosslinked polyester/polyurethane polymer (Envirocron PCU10101, obtained from PPG Industries), and 12.0 weight percent conductive carbon black (Conductex SC Ultra, obtained from Columbian Chemical), reference U.S. Ser. Nos. 140,437, 140,524, 140,594, 140,439 and 140,998, the disclosures of each of these patents being totally incorporated herein by reference.

The admix properties of this developer were characterized by the procedure described in Example I. After 90 minutes of paint shaking, the tribo was −26.1 microcoulombs per gram. This developer gave an average delta Q/d value of −0.03 femtocoulombs per micron, indicating a excellent admix performance, with very slight slow admix. The admix properties of this developer were characterized in a xerographic developer housing as in Example I. At the end of 2 percent area coverage, the tribo was −26.4 microcoulombs per gram. The average delta Q/d was −0.01 (very slight slow admix) during and shortly after (100 to 500 prints) the transition to a high print area coverage of 50 percent of the page; that is, a very low level of slow admix was observed in the xerographic developer housing in this test. However, there was no increase in background on the prints that were made during the period, a consequence of toner with low (or negative) Q/d values associated with poor admix.

EXAMPLE IV

A toner was prepared in the same manner as that of Example I, except that in the third step of the process to produce a toner, a toner blend was prepared by mixing the cyan toner above with 4.0 weight percent of NA50HS silica obtained from DeGussa/Nippon Aerosil Corporation,1.88 weight percent of SMT5103 crystalline titanium dioxide core MT500B with a primary particle size of about 25 to about 55 nanometers and a specific surface area of about 30 to about 50 $m^2/g$, surface treated with decyl silane (obtained from Tayca Corporation), 0.62 weight percent of H2050EP silica with polydimethylsiloxane units together with amino/ammonium functions chemically bonded onto the surface of highly hydrophobic fumed silica with a BET surface area of 110±20 $m^2/g$ (obtained from Wacker Chemie), and 0.3 weight percent of zinc stearate L obtained from Ferro Corporation. Therefore, overall this toner has coated onto the surface 4.0 percent of the negatively charging surface additive NA50HS and 2.5 percent of the positively charging external additives, SMT5103 and H2050EP, where the ratio of the two additives SMT5103/H2050EP is 75/25. The mixing was accomplished using the same condition as that of Example I.

A developer was prepared by mixing 4 parts of the blended toner with 100 parts of a carrier identical to that of Example III. The admix properties of this developer were characterized by the procedure described in Example I. After 90 minutes of paint shaking, the tribo was −23.1 microcoulombs per gram. This developer gave an average delta Q/d value of 0.01 femtocoulombs per micron, indicating an excellent admix performance. Developers with similar charge distributions have performed excellently when characterized in a xerographic developer housing and it is expected that this developer would have similarly acceptable performance.

EXAMPLE V

A toner was prepared in the same manner as that of Example I, except that in the third step of the process to produce a toner, a toner blend was prepared by mixing the cyan toner above with 3.5 weight percent of NA50HS silica obtained from DeGussa/Nippon Aerosil Corporation, 1.8 weight percent of SMT5103 crystalline titanium dioxide core MT500B with a primary particle size of about 25 to about 55 nanometers and a specific surface area of about 30 to about 50 $m^2/g$, surface treated with decyl silane (obtained from Tayca Corporation), 0.2 weight percent of H2050EP silica with polydimethylsiloxane units together with amino/ammonium functions chemically bonded onto the surface of highly hydrophobic fumed silica with a BET surface area of 110±20 $m^2/g$ (obtained from Wacker Chemie), and 0.3 weight percent of zinc stearate L obtained from Ferro Corporation. Therefore, overall this toner has coated onto the surface 3.5 percent of the negatively charging surface additive NA50HS and 2.0 percent of the positively charging external additives, SMT5103 and H2050EP, where the ratio of the two additives SMT5103/H2050EP was 90/10. The mixing was accomplished using the same condition as that of Example I.

A developer was prepared by mixing 4 parts of the blended toner with 100 parts of a carrier composed of a 77 micron volume median diameter atomized steel core (obtained from Hoeganaes) which is coated with 0.3 percent coating weight of a crosslinked polyester/polyurethane polymer (Envirocron PCU10101, obtained from PPG Industries), reference U.S. Ser. Nos. 140,437, 140,524, 140,594, 140,439 and 140,998, the disclosures of each of these applications being totally incorporated herein by reference.

The admix properties of this developer were characterized by the procedure described in Example I. After 90 minutes of paint shaking, the tribo was −6.5 microcoulombs per gram. This developer gave an average delta Q/d value of 0.07 femtocoulombs per micron, indicating an excellent admix performance. There was rapid admix, with unimodal charge distributions out to 2 minutes paint shaking. After 5 minutes paint shaking, slight charge-thru was evident. Developers with similar charge distributions performed excellently when characterized in a xerographic developer housing.

EXAMPLE VI

A toner was prepared in the same manner as that of Example V. A developer was prepared by mixing 4 parts of the blended toner with 100 parts of a carrier composed of a 77 micron volume median diameter atomized steel core (obtained from Hoeganaes) which was coated with 0.4 percent coating weight of a crosslinked polyester/polyurethane polymer (Envirocron PCU10101, obtained from PPG Industries), reference U.S. Ser. Nos. 140,437, 140,524, 140,594, 140,439 and 140,998, the disclosures of each of these applications being totally incorporated herein by reference.

The admix properties of this developer were characterized by the procedure described in Example I. After 90 minutes of paint shaking, the tribo was −24.0 microcoulombs per gram. This developer gave an average delta Q/d value of 0.03 femtocoulombs per micron, indicating an excellent admix performance. There was rapid admix, with unimodal charge distributions out to 2 minutes Paint Shaking. After 5 minutes paint shaking, slight charge-thru was evident. Developers with similar charge distributions have performed excellently when characterized in a xerographic developer housing.

EXAMPLE VII

A toner was prepared in the same manner as that of Example II. A developer was prepared by mixing 4 parts of the blended toner with 100 parts of a carrier composed of a 77 micron volume median diameter atomized steel core (obtained from Hoeganaes) which was coated with 1.0 percent coating weight of a polymethylmethacrylate polymer (obtained from Soken Chemical). The admix properties of this developer were characterized by the procedure described in Example I. After 90 minutes of paint shaking, the tribo was −49.1 microcoulombs per gram. This developer gave an average delta Q/d value of zero femtocoulombs per micron, indicating an excellent admix performance. Developers with similar charge distributions have performed excellently when characterized in a xerographic developer housing.

EXAMPLE VIII

A toner was prepared in the same manner as that of Example I, except that in the second step of the process, 56.77 parts by weight of the resin Resapol HT from above, 16.56 parts by weight of the 30 weight percent gel polyester from above, and 26.67 parts by weight of Sun Resin Bond Flush Yellow, which is a mixture of 30 weight percent P.Y.17 (C.I. 21105) and 70 weight percent Resapol HT prepared at Sun Chemical by flushing to obtain a high quality pigment dispersion, were blended together and extruded in a ZSK-40 extruder. The extruded blend was then jetted and classified to form a yellow toner (with 92 weight percent of resin and 8 weight percent of P.Y.17) with a toner particle size of about 7.3 microns as measured by a Layson Cell. The final yellow toner had a gel concentration of 5 weight percent.

In the third step of the process to produce a toner, a toner blend was prepared by mixing the yellow toner above with 4.5 weight percent of a fumed silica core L90 of approximately 30 nanometers of primary particle size and about 300 nanometers of aggregate size, and coated with decyl silane (obtained from Cabot Corporation), 2.7 weight percent of SMT5103 crystalline titanium dioxide core MT500B with a primary particle size of about 25 to about 55 nanometers and a specific surface area of about 30 to about 50 $m^2/g$, surface treated with decyl silane (obtained from Tayca Corporation), 0.3 weight percent of H2050EP silica with polydimethylsiloxane units together with amino/ammonium functions chemically bonded onto the surface of highly hydrophobic fumed silica with a BET surface area of 110±20 $m^2/g$ (obtained from Wacker Chemie), and 0.3 weight percent of zinc stearate L obtained from Ferro Corporation. Therefore, overall this toner had coated onto the surface 4.5 percent of the negatively charging surface additive NA50HS and 3.0 percent of the positively charging external additives, SMT5103 and H2050EP, where the ratio of the two additives SMT5103/H2050EP is 90/10. The mixing was accomplished using the same condition as that of Example I.

A developer was prepared by mixing 4 parts of the blended toner with 100 parts of a carrier composed of a 77 micron volume median diameter atomized steel core (obtained from Hoeganaes) which was coated with 1.0 percent coating weight of a polymethylmethacrylate polymer (obtained from Soken Chemical). The admix properties of this developer were characterized by the procedure described in Example I. After 90 minutes of paint shaking, the tribo was −41.8 microcoulombs per gram. This developer gave an average delta Q/d value of 0.12 femtocoulombs per micron. Charge distributions display rapid admix and a very small amount of charge-thru. The admix properties of this developer were characterized in a xerographic developer housing as in Example I. At the end of 2 percent area coverage, the tribo was −46.0 microcoulombs per gram. The average delta Q/d was 0.07 femtocoulombs per micron during and shortly after (about 100 to about 500 prints) the transition to a high print area coverage of 50 percent of the page. The charge distributions were unimodal and narrow. More importantly, there was no increase in background on the prints that were made during the period, a consequence of toner with low (or negative) Q/d values associated with poor admix.

Other modifications of the present invention may occur to one of ordinary skill in the art subsequent to a review of the present application, and these modifications, including equivalents thereof, are intended to be included within the scope of the present invention.

What is claimed is:

1. A toner comprised of resin, colorant and a surface additive mixture comprised of two coated silicas, and a coated metal oxide, and wherein said two coated silicas are comprised of a first silica and a second silica, and wherein the first coated silica contains a coating of an alkyl silane and an amino alkyl silane.

2. A toner in accordance with claim 1 further containing metal salts of fatty acids.

3. A toner in accordance with claim 1 wherein said first coated silica has a primary particle size of about 25 nanometers to about 55 nanometers and an aggregate size of about 225 nanometers to about 400 nanometers, and wherein said metal oxide is titanium dioxide.

4. A toner in accordance with claim 1 wherein said first coated silica contains a coating generated from a mixture of about 10 weight percent to about 25 weight percent of an alkylalkoxysilane, wherein said first silica has a primary particle size of about 25 nanometers to about 55 nanometers and an aggregate size of about 225 nanometers to about 400 nanometers, and wherein said metal oxide is titanium dioxide.

5. A toner in accordance with claim 1 wherein said second coated silica contains an organopolysiloxane coating, wherein said second silica has a primary particle size of about 5 nanometers to about 25 nanometers and an aggregate size of about 225 nanometers to about 400 nanometers, and wherein said metal oxide is titanium dioxide.

6. A toner in accordance with claim 1 wherein the toner further contains surface additives of metal salts, metal salts of fatty acids or mixtures thereof.

7. A toner in accordance with claim 1 wherein the ratio amount of the coated metal oxide to the relatively positive charging second coated silica ranges from about 98:2 to about 20:80.

8. A toner in accordance with claim 1 wherein the resin is polyester.

9. A toner in accordance with claim 1 wherein the resin is a polyester formed by condensation of propoxylated bisphenol A and a dicarboxylic acid.

10. A toner in accordance with claim 1 wherein the resin is comprised of a mixture of a polyester formed by condensation of propoxylated bisphenol A and fumaric acid, and a gelled polyester formed by the reactive extrusion of a polyester formed by the condensation of propoxylated bisphenol A and fumaric acid.

11. A toner in accordance with claim 1 wherein the colorant is carbon black, magnetite, or mixtures thereof, cyan, magenta, yellow, blue, green, red, orange, violet or brown, or mixtures thereof.

12. A toner in accordance with claim 1 wherein the first silica is coated with decylsilane.

13. A toner in accordance with claim 1 wherein the second silica is coated with an organopolysiloxane.

14. A toner in accordance with claim 1 wherein the first silica is coated with a mixture of an alkylsilane and aminosilane, and wherein each alkyl of said alkylsilane and said aminoalkylsilane contains from about 1 to about 25 carbon atoms.

15. A toner in accordance with claim 1 wherein the second silica is coated with an organopolysiloxane.

16. A toner in accordance with claim 14 wherein said alkyl is butyl, hexyl, octyl, decyl, dodecyl, or stearyl.

17. A toner in accordance with claim 1 wherein the first silica is coated with a polymer mixture of (1) said alkylsilane, and (2) said aminoalkylsilane.

18. A toner in accordance with claim 1 wherein the metal oxide is titania or titanium dioxide coated with an alkylsilane.

19. A toner in accordance with claim 18 wherein said alkyl is butyl, hexyl, octyl, decyl, dodecyl, or stearyl.

20. A toner in accordance with claim 1 wherein said metal oxide is titania coated with decylsilane.

21. A toner in accordance with claim 1 wherein the first coated silica contains a coating generated from a mixture of about 10 weight percent to about 25 weight percent of an alkyltrialkoxysilane, wherein said silica has a primary particle size of about 25 nanometers to about 55 nanometers and an aggregate size of about 225 nanometers to about 400 nanometers.

22. A toner in accordance with claim 1 wherein alkyl contains from 1 to about 25 carbon atoms.

23. A toner in accordance with claim 3 wherein the alkyltrialkoxysilane and the aminoalkyltrialkoxysilane are coated either in combination or sequentially.

24. A toner in accordance with claim 1 wherein the first silica is coated with an input feed mixture of about 5 to about 15 weight percent decyltrialkoxysilane.

25. A toner in accordance with claim 1 wherein the first silica has a primary particle size of about 25 nanometers to about 55 nanometers, and the coating is present on a core of silicon dioxide.

26. A toner in accordance with claim 1 wherein the second silica has a primary particle size of about 5 nanometers to about 25 nanometers, and the coating is present on a core of silicon dioxide.

27. A toner in accordance with claim 1 wherein the colorant is a pigment, or a dye.

28. A toner in accordance with claim 1 wherein the first silica is a negative charging silica, and which silica possesses a primary particle size of about 25 nanometers to about 40 nanometers.

29. A toner in accordance with claim 1 wherein the first and second silicas possess an aggregate size of about 225 nanometers to about 400 nanometers.

30. A toner in accordance with claim 1 wherein said coated first silica is present in an amount of from about 1 weight percent to about 10 weight percent; and said coated second silica is present in an amount from about 0.1 to about 3 weight percent.

31. A toner in accordance with claim 1 wherein said coated first silica is present in an amount of from about 3 weight percent to about 8 weight percent; and said coated second silica is present in an amount from about 0.1 to about 1 weight percent.

32. A toner in accordance with claim 31 wherein the metal oxide is titania present in an amount of from about 1 weight percent to about 5 weight percent, or wherein the titania is present in an amount of from about 1 weight percent to about 4 weight percent.

33. A toner in accordance with claim 2 wherein the metal salt is zinc stearate and is present in an amount of from about 1.10 weight percent to about 0.8 weight percent and the ratio of the coated metal oxide to the relatively positive charging second coated silica is from about (98:2) to about (20:80).

34. A developer comprised of the toner of claim 1 and carrier.

35. A developer in accordance with claim 34 with a toner charge to mass ratio of from about −15 to about −80 $\mu$C/g.

36. A developer in accordance with claim 34 with a toner charge to mass ratio of from about −20 to about −70 $\mu$C/g.

37. A developer in accordance with claim 34 with a unimodal charge distribution in a xerographic development environment, and which distribution is measured by a charge spectrograph.

38. A toner in accordance with claim 1 wherein the resin is present in an amount of from about 80 weight percent to about 98 weight percent and the colorant is present in an amount of from about 20 weight percent to about 2 weight percent.

39. A toner in accordance with claim 1 further optionally containing a charge additive, a wax, a compatibilizer, or mixtures thereof.

40. A process for the preparation of a toner comprising melt mixing resin and colorant, subsequently blending with two coated silicas and a coated metal oxide, and wherein said two coated silicas are comprised of a first silica and a second silica, and wherein the first coated silica contains a coating of an alkyl silane and an amino alkyl silane.

41. A toner in accordance with claim 1 wherein said first silica coating is a polymer, and said silica coating is contained on a silicon dioxide core.

42. A toner comprised of binder, colorant and a surface additive mixture comprised of at least two coated silicas, and a coated metal oxide, and wherein said first coated silica possesses a primary particle size of about 25 nanometers to about 55 nanometers.

43. A toner in accordance with claim 42 wherein said binder is a polymer.

44. A toner in accordance with claim 42 wherein said binder is a thermoplastic polymer.

45. A toner in accordance with claim 42 further containing metal salts of fatty acids.

46. A toner in accordance with claim 42 further containing metal salts.

47. A toner comprised of binder, colorant and a surface additive mixture comprised of a first coated silica, a second coated silica, and a coated metal oxide, and wherein said two coated silicas are comprised of a first silica and a second silica, and wherein the first coated silica contains a coating of an alkyl silane and an amino alkyl silane.

48. A toner in accordance with claim 47 wherein said metal oxide is titanium dioxide.

49. A toner in accordance with claim 47 further containing metal salts of fatty acids.

50. A developer comprised of the toner of claim 47 and carrier.

51. An imaging method comprising developing an image with the toner of claim 1.

52. An imaging method comprising developing an image with the toner of claim 2.

53. An imaging method comprising developing an image with the toner of claim 47.

54. An imaging apparatus containing the toner of claim 1.

55. A toner comprised of resin, colorant and a surface additive mixture comprised of at least two coated silicas, a coated metal oxide, and metal salts, metal salts of fatty acids or mixtures thereof, and wherein one of said coated silicas possesses a primary particle size of about 25 nanometers to about 55 nanometers, and an aggregate size of about 225 nanometers to about 400 nanometers.

56. A toner in accordance with claim 55 wherein two coated silicas are selected and which silicas are comprised of a first silica and a second positively charging silica, and wherein the ratio amount of the coated metal oxide to the positively charging second coated silica ranges from about 98:2 to about 20:80.

57. A toner in accordance with claim 55 wherein two coated silicas are selected and which silicas are comprised of a first silica and a second positively charging silica, and wherein the ratio amount of the coated metal oxide to the positively charging second coated silica ranges from about 55:45 to about 40:60.

58. A toner in accordance with claim 56 wherein said metal oxide is titanium dioxide.

59. A toner in accordance with claim 57 wherein said metal oxide is titanium dioxide.

60. A toner in accordance with claim 1 wherein said two coated silicas are comprised of a first silica and a second silica, and wherein the second silica is coated with an organopolysiloxane and wherein said metal oxide is titanium dioxide.

61. A toner comprised of resin, colorant and a surface additive mixture comprised of two coated silicas, a coated metal oxide, and metal salts, metal salts of fatty acids or mixtures thereof, and wherein the ratio amount of the coated metal oxide to the second coated silica ranges from about 98:2 to about 20:80.

62. A toner in accordance with claim 1 wherein the first silica possesses a primary particle size of about 25 nanometers to about 55 nanometers.

63. A toner in accordance with claim 1 wherein the second silica possesses a primary particle size of about 5 nanometers to about 25 nanometers.

64. A toner in accordance with claim 1 wherein said coated silicas each possess a primary particle size of from about 5 to about 25 nanometers.

65. A toner in accordance with claim 1 wherein the ratio amount of said second silica to said metal oxide is about 98:2 to about 40:60, about 98:2 to about 60:40, or about 95:5 to about 70:30.

66. A toner in accordance with claim 1 wherein the ratio amount of said second silica to said metal oxide is about 95:5 to about 85:15.

67. A toner in accordance with claim 55 wherein the ratio amount of said second silica to said metal oxide is about 95:5 to about 85:15.

68. A toner in accordance with claim 57 wherein the ratio amount of said second silica to said metal oxide is about 95:5 to about 85:15.

69. A toner in accordance with claim 1 wherein said first coated silica possesses a primary particle size of about 25 nanometers to about 55 nanometers, and an aggregate size of about 225 nanometers to about 400 nanometers.

70. A toner in accordance with claim 1 wherein said first coated silica is present in an amount of from about 1 weight percent to about 10 weight percent, and said second coated silica is present in an amount of from about 0.1 weight percent to about 3 weight percent, and said metal oxide is present in an amount of from about 1 weight percent to about 5 weight percent.

71. A toner in accordance with claim 1 wherein said metal oxide is present in an amount of from about 1 to about 4 weight percent.

72. A toner comprised of resin, colorant, and a surface additive mixture comprised of two coated silicas and a coated metal oxide, and wherein the first coated silica possesses a primary particle size of about 25 nanometers to about 55 nanometers, and an aggregate size of about 225 nanometers to about 400 nanometers.

73. A toner in accordance with claim 72 wherein said coated silica contains a coating of an alkyl silane and an amino alkyl silane.

74. A toner in accordance with claim 72 wherein the second coated silica contains an organo polysiloxane coating, and wherein said second silica has a primary particle size of about 5 nanometers to about 25 nanometers, and an aggregate size of about 225 nanometers to about 400 nanometers.

75. A toner comprised of resin, colorant, and a surface additive mixture comprised of a first silica and a second silica, and wherein each silica contains a coating thereover and wherein said first silica is coated with a mixture of an alkyl silane and an amino alkyl silane, and said first coated silica possesses a primary particle size of about 25 nanometers to about 55 nanometers, and an aggregate size of about 225 nanometers to about 400 nanometers, and wherein said second coated silica possesses a primary particle size of about 5 nanometers to about 25 nanometers, and an aggregate size of about 225 nanometers to about 400 nanometers.

76. A toner in accordance with claim 75 further containing a metal oxide of titanium dioxide.

77. A toner in accordance with claim 76 wherein the ratio amount of the coated metal oxide to the second coated silica ranges from about 98:2 to about 20:80.

78. A toner in accordance with claim 75 wherein the first coated silica is present in an amount of from about 1 weight percent to about 10 weight percent, and the second coated silica is present in an amount of from about 3 weight percent to about 8 weight percent.

79. A toner in accordance with claim 1 wherein the first coated silica is present in an amount of from about 3 weight percent to about 10 weight percent.

80. A toner in accordance with claim 1 wherein the first coated silica is present in an amount of from about 3 weight percent to about 8 weight percent.

81. A toner in accordance with claim 1 wherein the second coated silica is present in an amount of from about 3 weight percent.

* * * * *